US005863380A

United States Patent [19]

Gambetti

[11] Patent Number: 5,863,380

[45] Date of Patent: Jan. 26, 1999

[54] FOLDING AND GLUEING DEVICE FOR FOLDING AND APPLYING GLUE TO THE CLOSURE FLAPS OF BLANKS IN CONTINUOUSLY MOVING "WRAP AROUND" SLEEVE PACKAGING MACHINES

[75] Inventor: Mario Gambetti, Bologna, Italy

[73] Assignee: Baumer S.R.L., Castelfranco Emilia, Italy

[21] Appl. No.: 887,182

[22] Filed: Jul. 2, 1997

[30] Foreign Application Priority Data

Jul. 22, 1996 [IT] Italy ..... B096A0401

[51] Int. Cl.[6] ..... B65B 43/10

[52] U.S. Cl. ..... 156/443; 156/539; 156/578; 53/377.4; 53/377.5; 493/131; 493/144

[58] Field of Search ..... 493/130, 131, 493/132, 142, 144; 53/376.5, 377.2, 377.4, 377.5, 378.3; 156/443, 539, 547, 578

[56] References Cited

U.S. PATENT DOCUMENTS 4,642,966 2/1987 Marchetti .
5,154,041 10/1992 Schneider .
5,188,695 2/1993 Colton .

FOREIGN PATENT DOCUMENTS 2 171 467 2/1972 France .
26 12 458 10/1977 Germany .

*Primary Examiner*—Michael W. Ball
*Assistant Examiner*—Michael A. Tolin
*Attorney, Agent, or Firm*—Herbert Dubno; Yuri Kateshov

[57] ABSTRACT

A folding and glueing device (30) for folding and applying glue to the closure flaps (5) of blanks in continuously moving "wrap-around" sleeve packaging machines comprises a pair of coaxial and interconnected rotary members (14, 18), at least one driven rotary bar (26) borne in a rotary manner by and between the pair of rotary members (14, 18), transmission means (15, 28, 27) adapted to rotate the rotary bar (26) in phase relationship with the rotation of the pair of rotary members (14, 18), a closure blade disposed and secured along the rotary bar (26) and spray glueing means (22) positioned between the pair of rotary members (14, 18) in a central zone that does not interfere with the path described by the rotary bar (26) which is caused to move along a circular path by the rotary members (14, 18).

8 Claims, 5 Drawing Sheets

FOLDING AND GLUEING DEVICE FOR FOLDING AND APPLYING GLUE TO THE CLOSURE FLAPS OF BLANKS IN CONTINUOUSLY MOVING "WRAP AROUND" SLEEVE PACKAGING MACHINES

BACKGROUND OF THE INVENTION

Field of the Invention

The present invention relates to a folding and glueing device for folding and applying glue to the closure flaps of blanks in continuously moving "wrap-around" sleeve packaging devices, as disclosed, for instance, in British Patent Specification 2 233 954 in the name of the applicants.

The invention relates more particularly to a folding and glueing device of the above-mentioned type that is particularly adapted to cardboard wrap-around packagings in which the closure flap is articulated on the free end of the rear panel and has to be disposed within the finished package.

In this particular technological sector, the wrap-around blanks used by these packaging machines substantially comprise a first set of panels, normally four, extending longitudinally and consecutively in order to form the rear wall, the base wall, the front wall and the upper wall of the package when it is wound in the form of a sleeve about the product, eight lateral flaps articulated on the opposite longitudinal sides of the four panels mentioned above and adapted to form the heads of the package and a closure flap articulated on the longitudinal free end of the rear panel and adapted to be glued underneath the longitudinal free end of the upper panel.

Continuous packaging machines of the wrap-around sleeve type comprise a production line that substantially carries out the following operations: the association of the individual products with respective individual blanks by disposing these products on the base panel of these blanks; the partial winding of the individual blanks in the form of a sleeve about the respective products by erecting the rear panel against the rear portion of the product, the front panel against the front portion of the product and the upper panel over the upper portion of the product in a partly raised manner; the folding back over the heads of this product of the four flaps articulated on the sides of the rear panel and on the sides of the front panel; the folding towards the interior of the package of the closure flap and the application of glue to the upper surface thereof; the lowering of the upper panel in order to cause this closure flap to adhere to the inner longitudinal end portion of the upper panel; the application of glue to the outer surfaces of the four flaps previously folded back over the heads of the product; and, lastly, the folding of the flaps articulated on the upper panel and on the base panel against the flaps previously folded against the heads in order to obtain the fastening of these flaps.

At present, operations to fold the closure flap towards the interior of the package and to apply the glue thereto are carried out by folding and glueing devices provided with an alternating and/or intermittent movement which do not enable faultless folding of the closure flap, do not enable the use of high operating speeds and do not enable the correct application of the glue since during the spraying of this glue the plane of the closure flap is not perpendicularly opposite to the direction of spray from the nozzles.

SUMMARY OF THE INVENTION

The object of the present invention is to remedy the above- mentioned drawbacks.

The invention, as set out in the claims, remedies the problem of creating a folding and glueing device for folding and applying glue to the closure flaps of blanks in continuously moving wrap-around sleeve packaging machines.

The invention therefore relates to a folding and glueing device for folding and applying glue to the closure flaps of blanks in continuously moving wrap-around sleeve packaging machines using cardboard blanks in which the closure flap is articulated on the rear panel of the package to be formed and in which the individual packages, partly formed by erecting the rear panel against the rear portion of the product, are caused to advance in succession downstream one after the other along a conveyor line, wherein this folding and glueing device is characterised in that it comprises a pair of coaxial and interconnected rotary members, positioned individually on each side of the conveyor line, adapted to rotate about a first axis oriented perpendicularly and raised with respect to the conveyor line and actuated in phase relationship with the forward movement of the partial packages disposed along this conveyor line, at least one driven rotary bar, borne in a rotary manner by and between the pair of rotary members in the vicinity of their radial periphery, oriented parallel with respect to the first axis of rotation and adapted to move along a circular path, transmission means adapted to rotate the driven rotary bar in phase relationship with the rotation of the pair of rotary members, a closure blade disposed and secured along the driven rotary bar, spray glueing means, positioned in a fixed manner between the pair of rotary members and disposed in a central zone that does not interfere with the above-mentioned circular path described by the driven rotary bar.

The following results are obtained from the use of a device of this type: the folding properties of the closure flap are improved as it is folded along its whole extension, high operating speeds can be used and the glue is applied when the surface of the closure flap is disposed perpendicular to the direction of spray from the nozzles.

The advantages obtained by the present invention consist essentially in that better folded packages are obtained, in that the operating capacity of these packaging machines is increased and in that the glue is applied in an improved manner with the result that the closure flap is better glued to the upper panel.

Further characteristic features and advantages of the present invention are set out in further detail in the following description of a preferred practical embodiment thereof, given purely by way of non-limiting example, and made with reference to the accompanying drawings, in which:

BRIEF DESCRIPTION OF THE DRAWINGS

With reference to FIGS. 1 and 3, and as is known to persons skilled in the art, each individual blank shown by 10 in FIG. 3 is intended to form the package shown by 20 in FIG. 1.

DESCRIPTION OF THE PREFERRED EMBODIMENT

Figure 1:
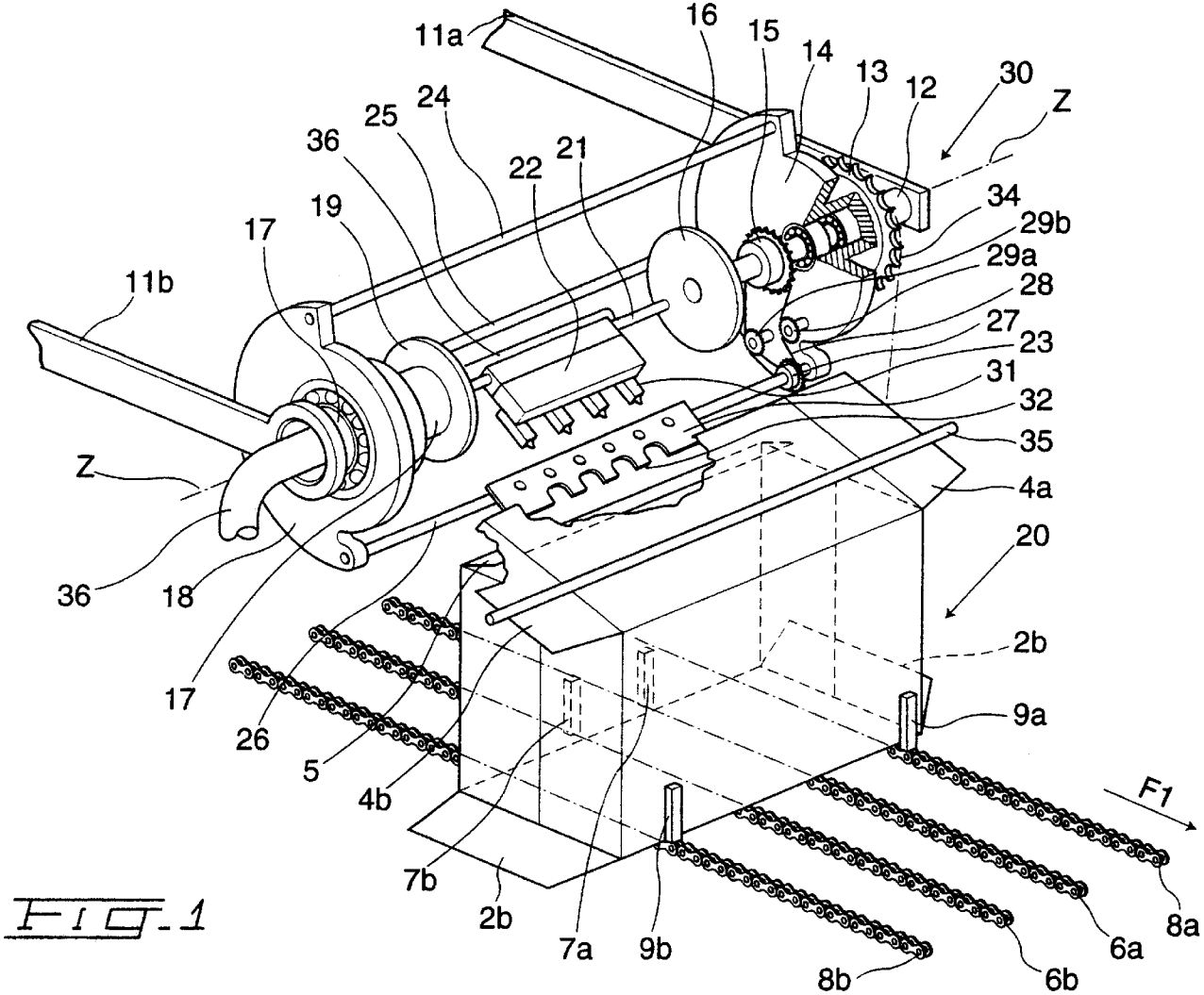
FIG. 1 is a diagrammatic perspective view of the device of the present invention.

The blank 10 substantially comprises a series of four consecutive panels 1, 2, 3 and 4 extending longitudinally along an axis x and articulated with one another to form the rear wall, the base wall, the front wall and the upper wall respectively of the package, a closure flap 5 adapted to be folded towards the interior of the package and secured by glue underneath the inner surface of the longitudinal free end of the upper panel 4 and eight lateral flaps 1*a,* 1*b,* 2*a,* 2*b,* 3*a,* 3*b,* 4*a,* 4*b,* articulated on the sides of the above-mentioned panels 1, 2, 3 and 4 and adapted to form the lateral walls or heads of the package 20.

In FIG. 1, the packaging machine comprises a conveyor line for partially formed packages 20 which substantially comprises a first pair of central chains 6*a* and 6*b* provided with respective folding members 7*a* and 7*b* adapted to maintain the base panel 1 erect and adjacent to the rear portion of the product, a second pair of chains 8*a* and 8*b* which are provided with respective folding members 9*a* and 9*b* adapted to maintain the front panel 3 erect and adjacent to the front portion of the product, wherein the chains 6*a,* 6*b* and 8*a,* 8*b* move downstream in the direction of the arrow F1, conveying the partially formed package 20 in the same direction.

The folding and glueing device shown overall by 30 and adapted to fold the closure flap 5 and to apply glue to its outer surface is disposed above the conveyor line and is borne by two brackets 11*a* and 11*b* of the machine structure.

The bracket 11*a* bears one end of a hub 12 which extends transversally towards the interior of the machine and which, in turn, bears, in a rotary manner, a first toothed wheel 13 associated with a first rotary member 14 and, in a keyed manner, a second toothed wheel 15 and a first disc 16.

The bracket 11*b* bears one end of a sleeve 17 which extends transversally towards the interior of the machine and which, in turn, bears, in a rotary manner, a second rotary member 18 and, in a keyed manner, a second disc 19.

The fixed disc 16 and the fixed disc 19 bear between one another a fixed bar 21 along whose extension a spray glueing unit 22 provided with four spray nozzles 23 is secured.

The rotary member 14 and the rotary member 18 are disposed coaxially with respect to an axis z oriented perpendicularly to the conveyor line for the packages 20 and, in order to rotate together, the rotary members 14 and 18 are interconnected by two fixed transverse bars 24, 25 and by a rotary transverse bar 26 which have their opposing ends disposed in the vicinity of the radial periphery of these rotary members 14 and 18. As a result of this arrangement, for the reasons explained below, when the two members 14 and 18 are rotated about the axis z, the bars 24, 25 and 26 move along a circular closed-loop path within which the spray glueing unit 22 is disposed so as not to interfere with this path.

The rotary bar 26 bears, in a keyed manner, a sprocket 27 which is engaged with a chain 28 which is also wound in a closed loop on the toothed wheel 15 via two tension rollers 29*a* and 29*b* so that the rotary bar 26 is driven in rotation about its own axis in phase relationship with the rotation of the rotary discs 14 and 18.

A folding blade 31, with a toothed profile 32 extending radially for the reasons explained below, is secured along the extension of this driven rotary bar 26.

The toothed wheel 13 is driven in rotation by a chain 34 which is connected to the transmission system of the conveyor line, in order to cause the rotary members 14 and 18 to rotate in phase relationship with the forward movement of the individual packages 20.

The spray glueing unit 22 is connected to the control means and the glue supply tank by cables shown by 36 which pass through the cavity of the sleeve 17 in order not to interfere with the path\ described by the bars 24, 25 and 26.

A known transverse folding stop bar 35, adapted to lower the upper panel 4 of the package 20 as the latter moves forward is also disposed downstream with respect to the folding and glueing device 30.

FIGS. 2A to 2F diagrammatically illustrate the operation of the folding and glueing device described above in which the two rotary members 14 and 18 rotate in unison in an anti-clockwise direction F2 and in phase relationship with the sequence of packages 20 being conveyed, while the folding blade 31, secured to the rotary bar 26, rotates in a clockwise direction F3 and in phase relationship with the rotation of the rotary members 14 and 18 and therefore also in phase relationship with the sequence of packages 20 being conveyed.

Figure 2B:
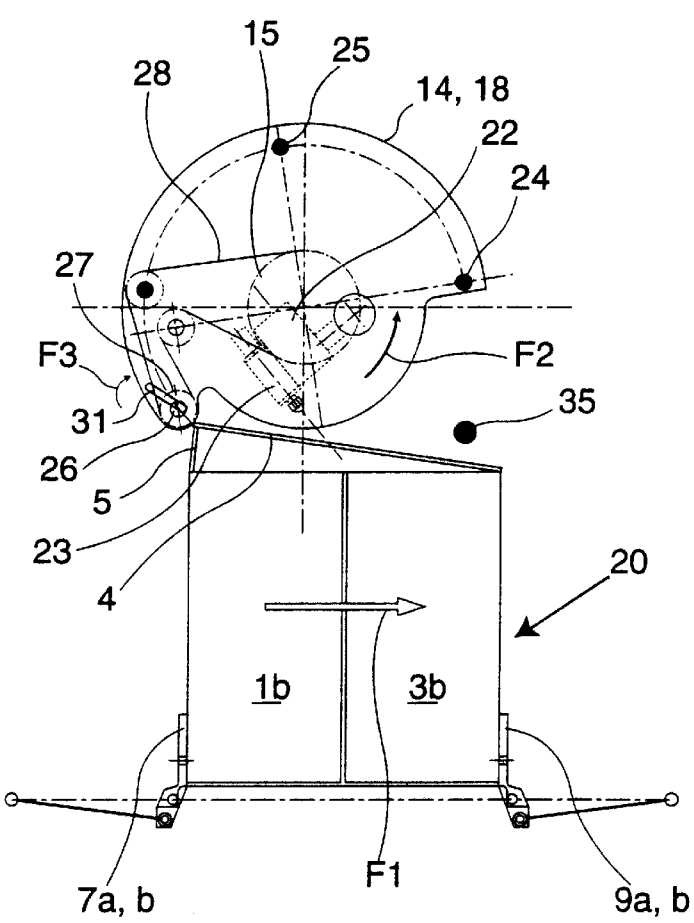
FIGS. 2A, 2B, 2C, 2D, 2E and 2F are diagrammatic side views showing, in sequence, the various operating stages of the device of FIG. 1.
Figure 2A:
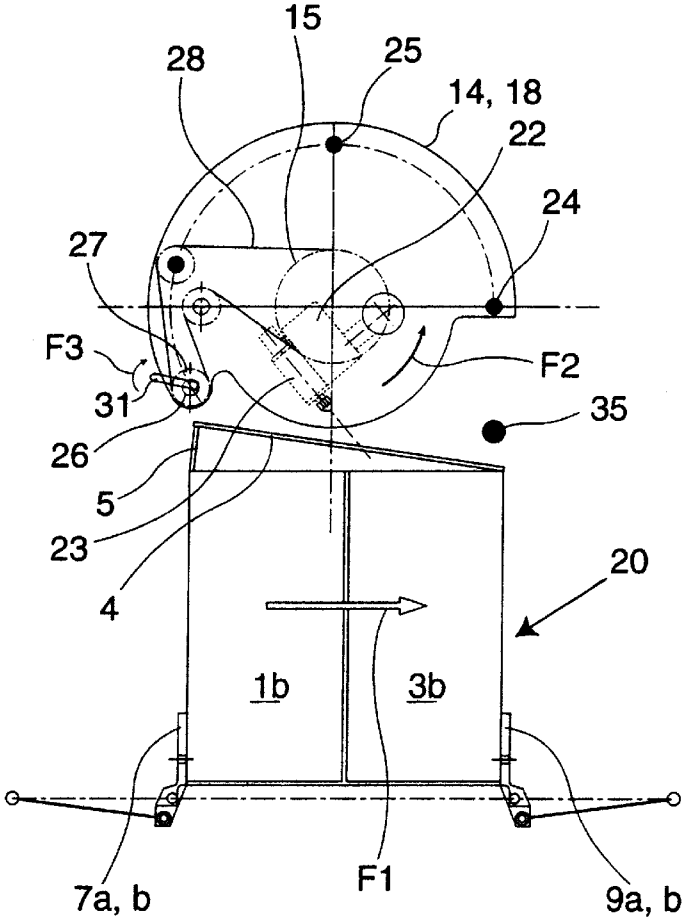
Figure 2D:
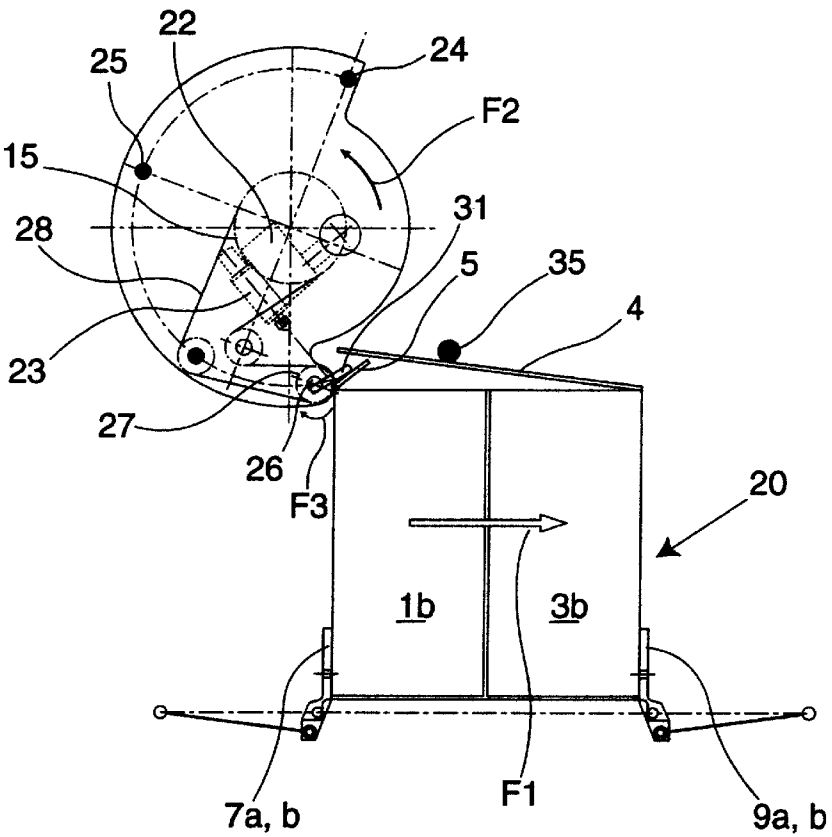
Figure 2C:
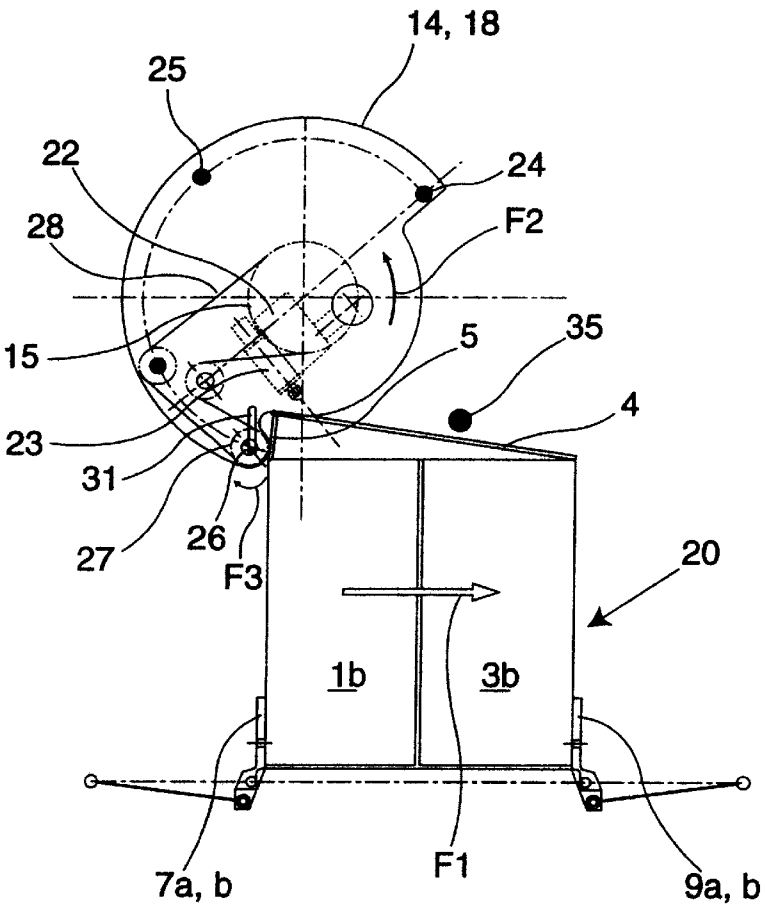

In FIG. 2A, the blade 31, which is moving along its circular path, is being lowered while the package 20 moves forward therebelow in the direction of the arrow F1 and, as shown in FIGS. 2B and 2C, this blade 31, as a result of the pre-selected synchronised operating speeds, is further lowered and disposed against the closure flap 5 with the end of the teeth 32 facing upwards.

In FIG. 2D, the blade 31 starts to fold the flap 5 inwards by acting along its entire extension following the advancing package and when this flap 5 is disposed perpendicular to the direction of spray of the nozzles 23, the latter are adapted on command to spray the glue against this flap 5 thereby ensuring, as a result of the particular arrangement created, that the glue is applied in an optimum manner.

With particular reference, moreover, to the configuration of the teeth 32 of the blade 31 and the arrangement of the nozzles 23, the zone affected by the glue spray is the zone disposed between these teeth 32, thereby preventing soiling of the blade 31.

Figure 2F:
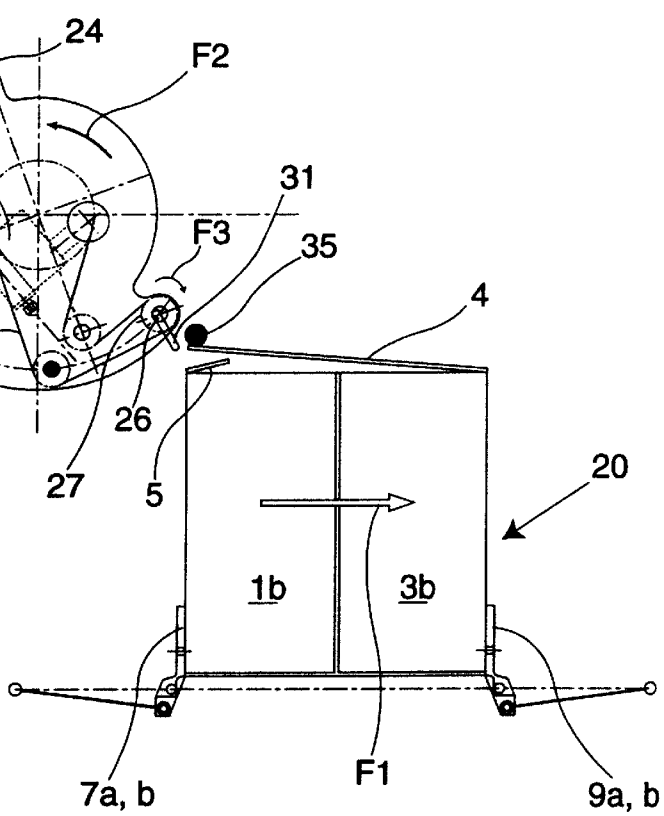
Figure 2E:
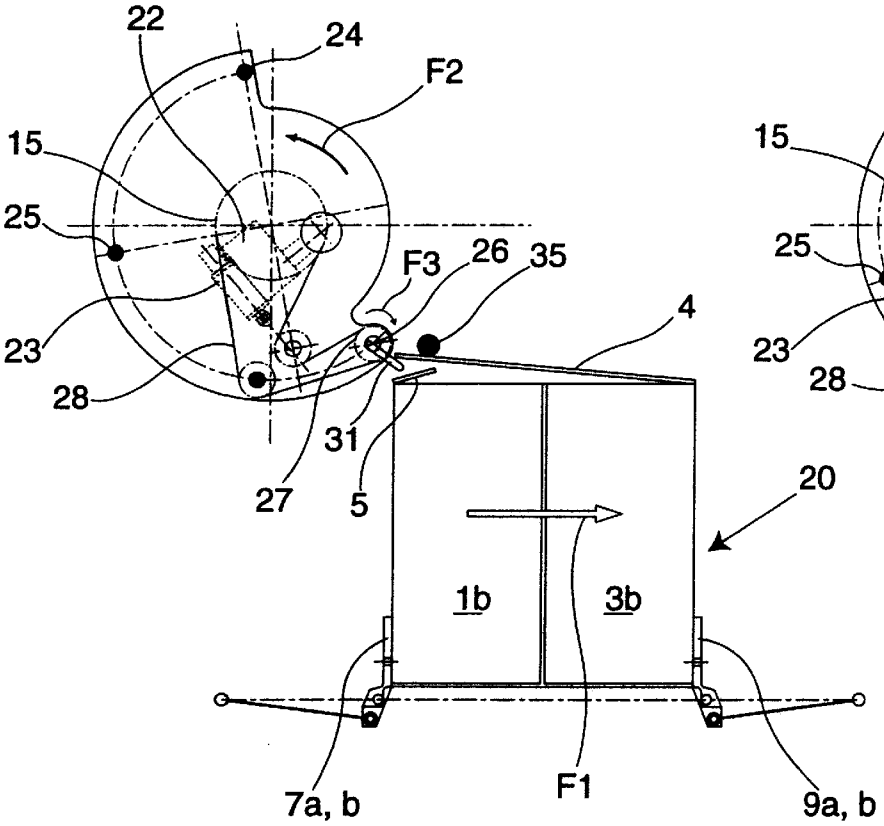
Figure 3:
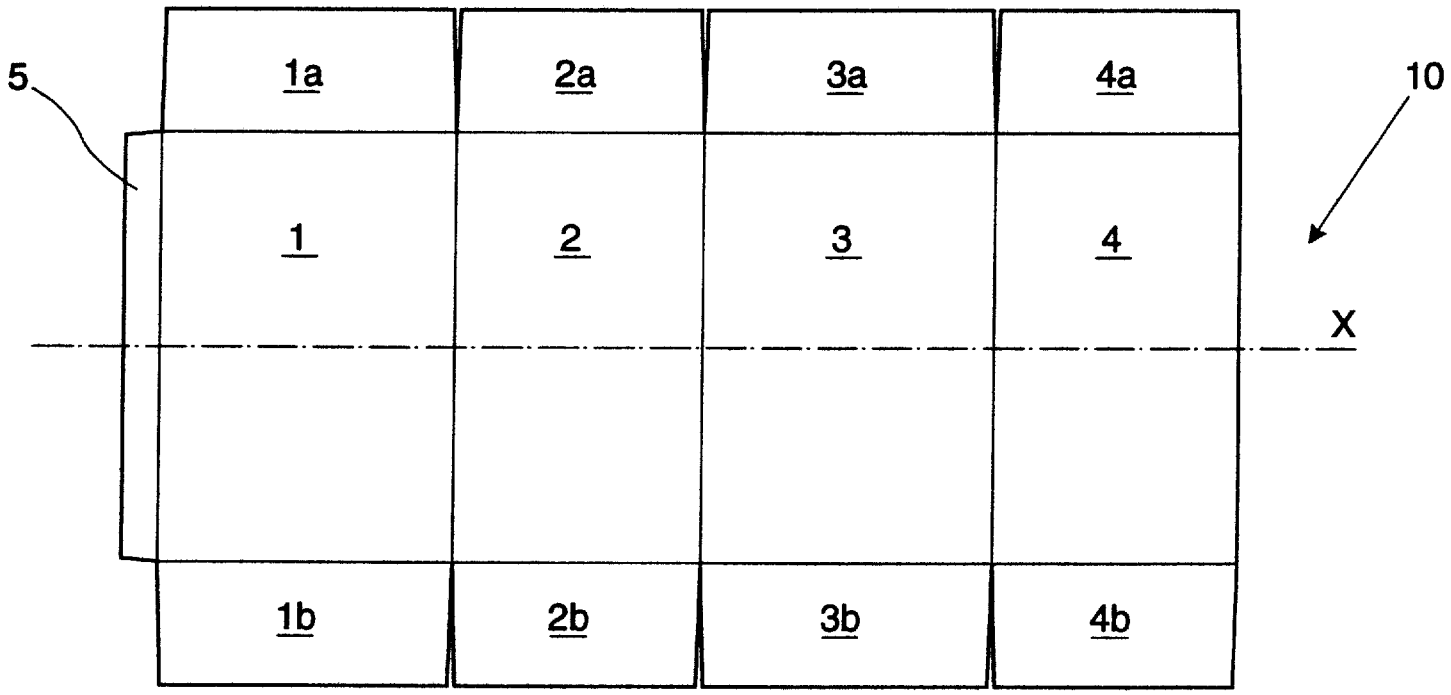
FIG. 3 is a plan view of the blank.

In FIG. 2E, the teeth 32 of the blade 31 move away from the downwardly inclined closure flap 5 so that the blade 31 can rise upwards along its circular path without interfering with the end of the upper panel 4 of the package 20 being supplied and the bar 35 is adapted further to lower this upper panel 4.

In FIG. 2F, the blade 31 is further spaced from the package 20 as the speed of longitudinal forward movement of the packages 20 is greater than the component of longitudinal forward movement of the blade 31 along its circular path, and the same package 20, with the closure flap 5 folded inwards and sprayed with glue along its upper surface, can continue its downward movement for the subsequent operations of compression in order to cause the upper panel 4 to adhere to the closure flap 5 so that they are connected to one another.

At this point, the blade 31, continuing to rotate about the rotary bar 26, continues along the circular path to repeat the folding and glueing operations of a closure flap of a subsequent package in the manner described above.

With reference to the folding and glueing device 30 described above, it is evident that it can be provided with two or more rotary bars 26 provided with respective folding blades 31 and/or different mechanical and/or electrical and/or electronic transmission means adapted, however, to form an epicyclic device in which the blade 31 acts as a satellite and moves along a circular path, rotating about itself and defining an epicycle with the end of its teeth 32 adapted to fold the closure flap 5.

The above description of the folding and glueing device is given purely by way of non-limiting example and it is therefore evident that all those modifications and variants suggested by practice and by its use or application can be made thereto provided that they do not depart from the scope of the following claims.

I claim:

1. A folding and glueing device for folding and applying glue to the closure flaps (5) of blanks (10) in continuously moving wrap-around sleeve packaging machines using cardboard blanks (10) in which the closure flap (5) is articulated on the rear panel (1) of the package (20) to be formed, in which the individual packages (20), partly formed by erecting the rear panel (1) against the rear portion of the product, are caused to advance in succession downstream one after the other along a conveyor line (6*a,* 6*b,* 8*a,* 8*b*), characterised in that it comprises:

a pair of coaxial (z) and interconnected rotary members (14, 18), positioned individually on each side of the conveyor line (6*a,* 6*b,* 8*a,* 8*b*), adapted to rotate about a first axis (z) oriented perpendicularly and raised with respect to the conveyor line (6*a,* 6*b,* 8*a,* 8*b*) and actuated in phase relationship with the forward movement of the partial packages (20) disposed along this conveyor line (6*a,* 6*b,* 8*a,* 8*b*), at least one driven rotary bar (26), borne in a rotary manner by and between the pair of rotary members (14, 18) in the vicinity of their radial periphery, oriented parallel with respect to this first axis of rotation (z) and adapted to move along a circular path, p1 transmission means (15, 28, 27) adapted to rotate the driven rotary bar (26) in phase relationship with the rotation of the pair of rotary members (14, 18), a closure blade (31) disposed and secured along the driven rotary bar (26), spray glueing means (22), positioned in a fixed manner between the pair of rotary members (14, 18) and disposed in a central zone that does not interfere with the above-mentioned circular path described by the driven rotary bar (26).

2. A device as claimed in claim 1, characterised in that the pair of coaxial rotary members (14, 18) are interconnected by a plurality of fixed bars (24, 25) having their opposite ends secured along the radially external periphery of each rotary member (14, 18).

3. A device as claimed in claim 1, characterised in that one (18) of the rotary members (14, 18) is borne in a rotary manner by a sleeve (17) extending transversally from one side of the packaging machine towards the interior thereof and within which the cables (36) for the control and supply of the spray glueing means (22) pass.

4. A device as claimed in claim 1, characterised in that the nozzles (23) of the spray glueing means (22) are adapted to spray the glue when the plane of the closure flap (5) is disposed perpendicularly to the direction of spray from these nozzles (23).

5. A device as claimed in claim 1, characterised in that the rotary bar (26) is driven to rotate about itself by a sprocket (27) keyed thereon and engaged with a chain (28) which is also wound in a closed loop about a toothed wheel (15) borne in a fixed manner on the first axis (z).

6. A device as claimed in claim 5, characterised in that it comprises two brackets (11*a,* 11*b*) disposed on each side of the packaging machine, wherein one bracket (11*a*) bears a hub (12) which extends transversally towards the interior of the packaging machine and bears, in a rotary manner, one rotary member (14) of the pair of rotary members (14, 18) and the other bracket (11*b*) bears a sleeve (17) which extends transversally towards the interior of the packaging machine and bears, in a rotary manner, the other rotary member (18) of the pair of rotary members (14, 18).

7. A device as claimed in claim 6, characterised in that the spray glueing unit (22) is borne (16, 21, 19) by and between the hub (12) and the sleeve (17).

8. A device as claimed claim 7, characterised in that the closure blade (31) has a toothed profile (32) and in that the spray glueing means (22) are adapted to spray the glue solely in the zones formed between these teeth (32) in order to prevent soiling of the blade (31).

* * * * *